US008166726B2

(12) United States Patent
Dang

(10) Patent No.: US 8,166,726 B2
(45) Date of Patent: May 1, 2012

(54) TILE LEVELING PROCESS AND APPARATUS

(76) Inventor: Tuan N. Dang, Lake Mary, FL (US)

( * ) Notice: Subject to any disclaimer, the term of this patent is extended or adjusted under 35 U.S.C. 154(b) by 139 days.

(21) Appl. No.: 12/653,639

(22) Filed: Dec. 17, 2009

(65) Prior Publication Data

US 2011/0146200 A1 Jun. 23, 2011

(51) Int. Cl.
*E04B 1/00* (2006.01)
*E04F 13/08* (2006.01)

(52) U.S. Cl. ..... 52/747.11; 52/389; 52/126.5

(58) Field of Classification Search ..... 52/396.1, 52/396.04, 396.08, 391, 392, 385, 386, 387, 52/389, 126.1, 126.5, 403.1, 747.1, 747.11, 52/747.12, 749.11; 33/527, 526, 645
See application file for complete search history.

(56) References Cited

U.S. PATENT DOCUMENTS 2,111,003 A * 3/1938 Petty ..... 52/603
2,852,932 A 9/1958 Cable
3,234,692 A * 2/1966 Georg ..... 52/392
3,501,877 A 3/1970 White
3,861,098 A * 1/1975 Schaub ..... 52/98
4,503,654 A * 3/1985 Cosentino ..... 52/747.11
4,953,341 A 9/1990 Joos
RE35,380 E 11/1996 Rea et al.
6,354,058 B1 3/2002 Lewis
6,625,951 B1 * 9/2003 McCarthy ..... 52/747.1
6,823,640 B1 11/2004 Pytlewski
7,140,156 B1 11/2006 Lowe, Jr. et al.
2004/0123538 A1 * 7/2004 Ko ..... 52/385

* cited by examiner

*Primary Examiner* — Jessica Laux
(74) *Attorney, Agent, or Firm* — William M. Hobby, III

(57) ABSTRACT

The process of tiling a floor is disclosed in which the leveling of the tile members being attached to a floor or counter top includes selecting and attaching a plurality of tile height spacers to each piece of tile. Each tile height spacer has a plurality of feet extending from one side thereof and an adhesive coating on the other side having a protective cover thereover. The adhesive cover is removed from the tile so that the tile height spacer can be attached to the bottom of a tile member for pressing the tile member and tile height spacers attached thereto into the tile bonding agent applied to the floor for leveling the tile.

7 Claims, 2 Drawing Sheets

TILE LEVELING PROCESS AND APPARATUS

BACKGROUND OF THE INVENTION

The present invention relates to a process for rapidly leveling the height of ceramic tiles and the like to thereby speed up the process of installing a tile floor or counter top.

Ceramic tile, marble tiles or stone tiles are commonly used to cover the surface of kitchen and bathroom floors, walls and counter tops. Ceramic tiles are fired clay having a decorative and impervious surface. Tiles are typically square or rectangular in shape and in different sizes. Most ceramic tiles have projections on their edges to space them from abutting tiles. There are also tiles for corners, baseboards and the like. Laying tiles involves preparing a smooth floor surface and planning a pattern and then attaching the tiles with an adhesive. The adhesive used may be cement based mortar or an epoxy as well as an epoxy mortar or latex mortar or the like. After the tile is set in the adhesive, the tiles are leveled and the spaces between them are filled with grout. A common step in laying floor tiles is to provide a mud surface. A floor mud is typically a mixture of Portland cement, sand and water smoothed over the floor surface where the tiles need to be set. A floor mud surface is typically from ¾" to 2-3" thick and provides a level surface for attaching the tile. The tiles can be attached directly to a cement or other floor if the floor is sufficiently level. Alternatively, a backer board can be utilized for leveling of an uneven floor. Once the adhesive combining agent is placed over the floor, the tiles must be positioned in a directed pattern, spaced from each other and pressed into the bonding agent. Leveling the tiles relative one to the other once they are placed into the bonding agent is commonly a slow step in the process of setting tiles.

The present invention is directed to a method and apparatus for rapidly leveling the height of the tile to thereby speed up the process of laying tiles. Ceramic tiles will typically have projections on the edge to space them from abutting tiles, leaving sufficient space between the tiles which is filled with grout. With tiles not having edge projections, such as in marble or stone tiles, inexpensive plastic spacers are available to space one tile from the edge of the abutting tiles.

In the past, there have been any number of spacers for spacing adjacent tiles relative to each other, some of which can be seen in the Joos U.S. Pat. No. 4,953,341 for spacers for laying tile and method of their use and in the Lewis U.S. Pat. No. 6,354,058 for a method and apparatus for laying tile. In the Rea et al. U.S. Pat. No. RE 35,380, a tile mounting system is provided which uses a tiling matrix. In the S. J. Cable U.S. Pat. No. 2,852,932 a tile and grouting assembly is provided. In the Lowe, Jr. et al. U.S. Pat. No. 7,140,156, a system for installing of decking tiles is provided while the Pytlewski U.S. Pat. No. 6,823,640 has a hollow spacer for tiles for insertion into intersecting joint spaces between tile courses which is left in place after the spaces have been filled with grout. In the J. S. White U.S. Pat. No. 3,501,877, a masonry joint spacer is provided for spacing joints in masonry walls and the like.

The present invention is directed towards assisting and speeding up the process of laying a tile floor and the like by providing a tile height spacer for more rapidly positioning the height of all four corners of a tile quickly and with less effort to thereby speed up the process of laying a tile floor.

SUMMARY OF THE INVENTION

The process of leveling tile includes the steps of selecting a plurality of tile height spacers, each having a predetermined thickness and having two sides and having a plurality of spaced feet extending from one side thereof and having an adhesive coating on the other side thereof having a protective cover thereover. Next, an adhesive tile is selected having a top and bottom side and then removing the protective cover from a plurality of selected tile height spacers and adhesively attaching each of the selected spacers to the bottom of the selected piece of tile, each in a spaced relationship to the others. A surface floor to be tiled is then coated with a tile bonding agent, such as an epoxy or a cement based mortar or a latex mortar or an epoxy mortar combination or other adhesive. The floor surface may have been previously mudded, which is applying a coat of floor mud which typically might be comprised of Portland cement, sand and water mixed together. The mud is placed over a floor in a thickness between ¾" and 2-3". The tile having the plurality of selected tile height spacers attached thereto is then pressed with the bottom side into the tile bonding agent to force the plurality of tile spacer feet through the bonding agent and against the floor to thereby quickly level each piece of tile on the level surface. A plurality of selected tile height spacers may include four, one placed on each corner of the selected tile, and each tile height spacer may have four feet extending therefrom and may be made of a polymer material. The tile height spacer adhesive cover may be a wax paper adhesive cover. The tile height spacer apparatus for leveling tile may include a generally square polymer spacing member having a predetermined thickness and having two sides and having a plurality of generally square feet spaced apart in a spaced relationship to each other. Each spacing member has an adhesive coating on the other side thereof having a protective cover thereover so that a spacing member can be adhesively attached to a piece of tile being laid for leveling the tile relative to the floor.

BRIEF DESCRIPTION OF THE DRAWINGS

Other objects, features, and advantages of the present invention will be apparent from the written description and the drawings in which.

DESCRIPTION OF THE PREFERRED EMBODIMENT

Figure 1:
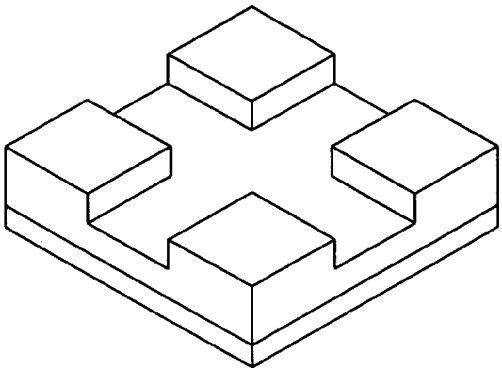
FIG. 1 is a perspective view of the tile height spacer in accordance with the present invention.
Figure 2:
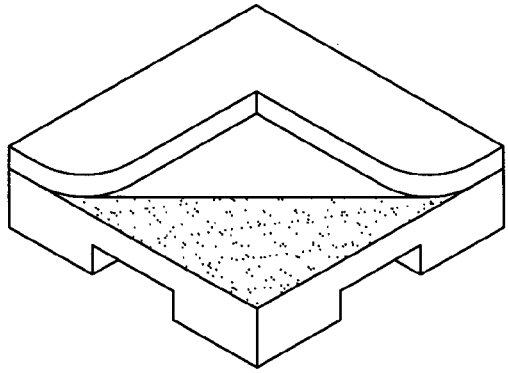
FIG. 2 is a perspective view of the tile height spacer of FIG. 1 having the adhesive cover being removed.

Referring to FIGS. 1 and 2 of the drawings, a tile height spacer 10 has a spacer body 11 having four feet 12 extending from one side thereof and having an adhesive coating 13 on the other side thereof. The adhesive coating 13 has a cover 14 protecting the adhesive, which cover may be a wax paper cover. The title height spacer 10, body 11, and feet 12 may be molded of a polymer material, such as PVC or polyethylene or any other material desired.

Figure 3:
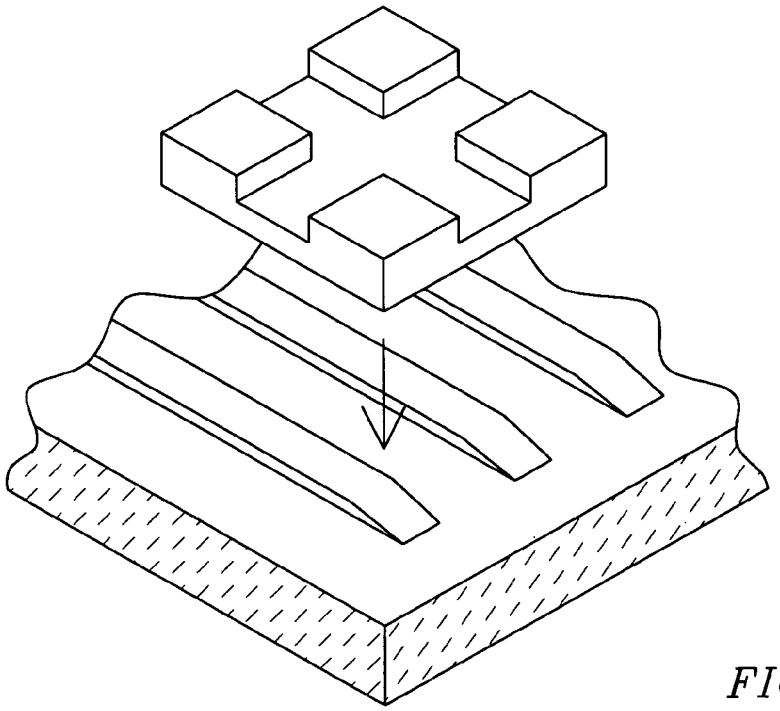
FIG. 3 is a perspective view of the tile height spacer of FIGS. 1 and 2 being applied to the bottom edge of a tile surface.
Figure 4:
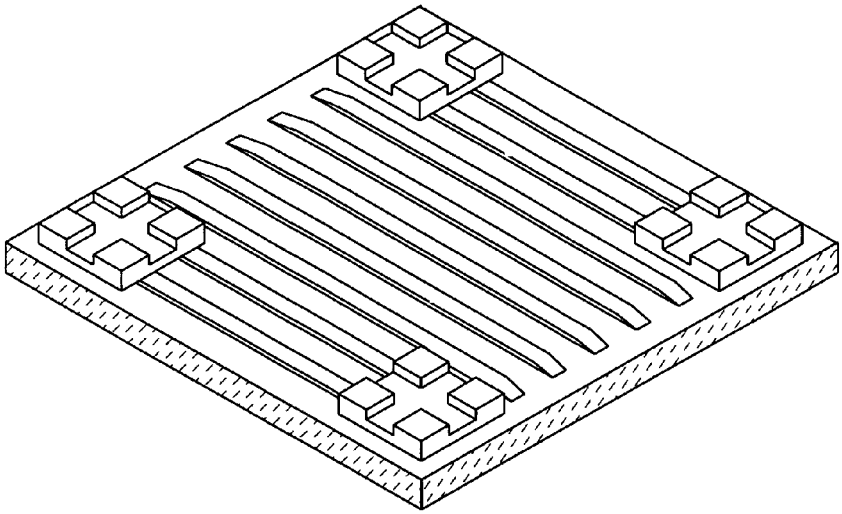
FIG. 4 is a perspective view of the bottom side of a tile member having tile height spacers of the present invention attached thereto.
Figure 5:
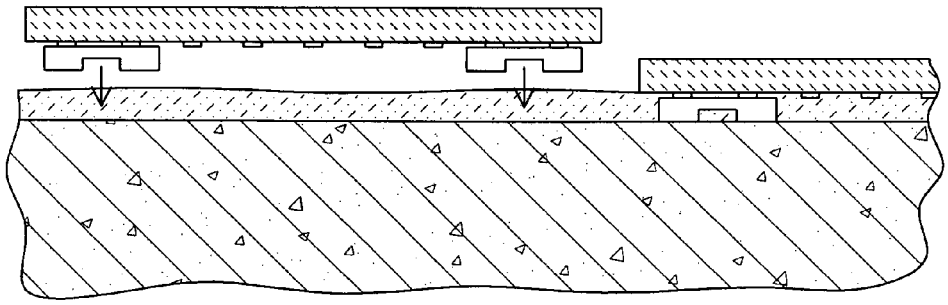
FIG. 5 is a sectional view through a mudded floor having a tile attached to the surface thereof.

Referring more specifically to FIGS. 3-5, a tile 15 can be a ceramic tile or a stone tile or a marble tile or any type of tile desired and may be of any shape but typically is a square or rectangular shaped having sides from one inch to 18 inches.

As shown in FIG. 3, a tile height spacer 10 has had the cover 14 removed from the adhesive 13 in FIG. 2 and is being positioned over the tile 15 with the adhesive facing the tile and the feet 12 facing away from the bottom of the tile 15. The tile 15 has a bottom surface 16 and a top surface 17. The tile height spacer 10 adhesive side 13 is shown attached to the four corners of the tile member 15, as seen in FIG. 4, with all of the tile height spacer feet 12 facing away from the bottom 16. The tile height spacer being adhesively attached with the adhesive 13 to the bottom of the tile 15.

Turning to FIG. 5, a tile member 15 having the tile height, spacers 10 attached in FIG. 4 is being applied to a concrete floor 18. The floor 18 can be of a mudded floor in which floor mud covers the existing floor for leveling the floor. The mud typically is a Portland cement, sand and water mixture which has been applied in a thickness from ¾" to 2-3" thick and has had a thick layer of adhesive 20 spread thereover. The adhesive 20 may be a cement based mortar or an epoxy or latex mortar or an epoxy mortar combination or the like. The tile member 15 having the tile height spacers attached thereto is pressed directly into the bonding agent 20, as shown in a second tile member in FIG. 5. Pushing the tile spacer into the bonding agent 20 and against the surface 21 of the floor 18 levels the tile member relative to the other tiles. This allows the tile members 15 to be laid more rapidly by the quick leveling of the tile member 15 relative to all four corners of the tile member so that one tile is level relative to the next to provide a smooth level tiled floor. Ceramic tiles would typically have small projections extending from the edge to space one tile member from the other but, in the absence of these projections, there are available inexpensive tile spacers that can be placed on the corner or between the tiles to evenly space one tile from the next.

It should be clear at this time that a tile leveling process has been provided for allowing the more rapid installation of tile members, such as marble tiles or ceramic tiles while allowing them to be more rapidly leveled as each tile is installed on a floor. It should also be clear that a tile height spacer apparatus has also been shown and described. However, the present invention is not to be construed as limited to the forms shown which are to be considered illustrative rather than restrictive.

I claim:

1. A process of leveling tile comprising the steps of:

selecting four tile height spacers, each said tile height spacer having a predetermined thickness and having two sides and having a plurality of spaced feet extending from one side thereof, each said tile height spacer having an adhesive coating on the other side thereof having a protective cover thereover;

selecting a piece of tile having a top and a bottom side;

removing the protective cover from said four selected tile height spacers;

adhesively attaching each of said selected tile height spacers to the bottom side of said selected piece of tile in a spaced relationship to each other;

coating a floor surface with a tile bonding agent;

pressing said tile bottom side and four tile height spacers thereon onto the floor surface tile bonding agent to force said plurality of tile spacer feet through the bonding agent and against the floor;

whereby tile being set onto a floor surface is easily leveled.

2. The process of leveling tile in accordance with claim 1 in which the step of selecting a plurality of tile height spacers includes selecting each tile height spacer having four feet extending from one side thereof.

3. The process of leveling tile in accordance with claim 2 in which the step of selecting four tile height spacers includes selecting four polymer tile height spacers.

4. The process of leveling tile in accordance with claim 3 in which each polymer tile height spacer is a PVC tile height spacer.

5. The process of leveling tile in accordance with claim 4 in which each selected tile spacer is a general square tile spacer having a plurality of feet extending from one side thereof.

6. The process of leveling tile in accordance with claim 1 in which each selected tile height spacer has four generally square feet extending from one side thereof.

7. The process of leveling tile in accordance with claim 1 in which each tile height spacer adhesive cover is a waxed paper adhesive cover.

* * * * *